US008161942B2

(12) United States Patent
Lei et al.

(10) Patent No.: US 8,161,942 B2
(45) Date of Patent: Apr. 24, 2012

(54) IGNITION CONTROL DEVICE

(75) Inventors: Deyou Lei, Shangyu (CN); Jiangang Dong, Shangyu (CN)

(73) Assignee: Shao Xing Fenglong Electrical Machinery Co., Ltd, Shangyu, Zhejiang Province (CN)

( * ) Notice: Subject to any disclaimer, the term of this patent is extended or adjusted under 35 U.S.C. 154(b) by 854 days.

(21) Appl. No.: 12/098,536

(22) Filed: Apr. 7, 2008

(65) Prior Publication Data

US 2008/0252219 A1 Oct. 16, 2008

(30) Foreign Application Priority Data

Apr. 13, 2007 (CN) ..... 2007 2 0068964 U
Jan. 31, 2008 (CN) ..... 2008 2 0006060 U

(51) Int. Cl.
*F02P 5/145* (2006.01)
*F02P 15/00* (2006.01)
*F02D 45/00* (2006.01)
*H05B 41/14* (2006.01)

(52) U.S. Cl. ..... 123/406.57; 123/146.5 B; 123/198 DC; 315/119; 361/265

(58) Field of Classification Search ..... 123/596, 123/598, 599, 605, 617, 625, 632, 640, 406.13, 123/406.19, 406.32, 146.5 B, 198 D, 198 DC, 123/406.57, 618, 630; 315/119; 361/265
See application file for complete search history.

(56) References Cited

U.S. PATENT DOCUMENTS

| | | | | |
|---|---|---|---|---|
| 4,356,809 | A * | 11/1982 | Lo Cascio | 123/632 |
| 4,469,082 | A * | 9/1984 | Nishitoba et al. | 123/609 |
| 4,493,307 | A * | 1/1985 | Trinh et al. | 123/630 |
| 4,836,176 | A * | 6/1989 | Fujino et al. | 123/640 |
| 5,048,503 | A * | 9/1991 | Suzuki et al. | 123/632 |
| 5,584,280 | A * | 12/1996 | Kinoshita et al. | 123/406.57 |
| 5,635,801 | A * | 6/1997 | Regazzi et al. | 315/209 CD |
| 5,819,713 | A * | 10/1998 | Kesler | 123/630 |
| 6,138,653 | A * | 10/2000 | Juffinger | 123/598 |
| 6,360,720 | B1 * | 3/2002 | Kesler | 123/406.55 |
| 6,450,157 | B1 * | 9/2002 | Kesler et al. | 123/630 |
| 6,701,896 | B2 * | 3/2004 | Kiessling | 123/406.57 |
| 7,066,161 | B2 * | 6/2006 | Romero et al. | 123/596 |
| 7,069,921 | B1 * | 7/2006 | Kolak et al. | 123/599 |
| 7,121,270 | B1 * | 10/2006 | Plotnikov | 123/604 |
| 7,156,075 | B2 * | 1/2007 | Kiessling | 123/406.56 |
| 7,800,174 | B2 * | 9/2010 | Yamaguchi et al. | 257/341 |
| 2003/0155867 | A1 * | 8/2003 | George Kinge | 315/209 SC |
| 2005/0224909 | A1 * | 10/2005 | Yamaguchi et al. | 257/528 |

* cited by examiner

*Primary Examiner* — Willis Wolfe, Jr.
*Assistant Examiner* — Johnny Hoang
(74) *Attorney, Agent, or Firm* — Dority & Manning, P.A.

(57) ABSTRACT

The invention provides an ignition control device and a killing control device correspond. An ignition control device comprises an ignition circuit module and a killing control device corresponds. The ignition circuit module comprises a killing control device including a killing switch and a timing retard circuit module connected to the ignition circuit module. When the killing control operates, the ignition circuit stops igniting. The invention has following advantages: reasonable structure, low cost, stable control circuit and safe operation and so on.

3 Claims, 5 Drawing Sheets

IGNITION CONTROL DEVICE

CROSS-REFERENCE TO RELATED APPLICATIONS

This application claims priority to Chinese Application No. CN200720068964.5 file Apr. 13, 2007 and Chinese Application No. CN200820006060.4 filed Jan. 31, 2008.

TECHNICAL FIELD

The invention relates to an ignition control device, specially to an ignition control device with a killing control device correspond.

BACKGROUND OF THE INVENTION

A micro engine such as a gas engine which working process is shown as in FIG. 1 is usually used to a micro machine such as a trimmer and so on. The existing micro engine is usually rotated by the outside force. The coil produces a voltage driving the ignition circuit module of the ignition control device by induction after the coil cutting the magnetic lines of force. The engine ignites and works after the ignition circuit module outputs high voltage. When the machine need be closed, the power of the ignition circuit module is shorten after actuating the killing switch, then the engine stops igniting so that the rotate speed changes from high to low until fully stop.

In prior art, the ignition control device may be set on the normal ready state once cutting the killing switch, since the power of the ignition circuit module is shorten and grounded directly after turning on the killing switch. Then when working, there exits more serious danger because the engine may be in low rotate speed when the ignition control device recovers the normal work state so that the ignition control device start again. The killing coil is also used to send the signal to the killing circuit in prior art, but it has some disadvantages such as complicated manufacture, unstable quality, inferior security and high cost and so on.

OBJECTS AND BRIEF SUMMARY OF THE INVENTION

The object of the invention is providing an ignition control device and a killing control device correspond with reasonable structure, low cost, reliable control circuit and safe operation.

To achieve said object, the invention provides the following technique design.

An ignition control device comprises an ignition circuit module and a killing control device corresponds. The ignition circuit module comprises a killing control device including a killing switch and a timing retard circuit module connected to the ignition circuit module. When the killing control operates, the ignition circuit stops igniting. The engine rotates by the outside force and drives the ignition circuit module of the ignition control device through the induction of the coil. Then the engine is ignited and starts to working after the ignition circuit module outputting the high voltage. After actuating the killing switch of the killing control device, the ignition circuit module stops outputting the ignition voltage immediately and the engine stops igniting when the killing control device operates.

The timing retard circuit module of the killing control device comprises at least one level charge circuit module. The level of the charge circuit may be set to two levels or more corresponding to the rotate speed of the engine. By selecting the different levels, the time of the ignition circuit without ignition voltage may be controlled so as to the engine is in fully stopping state. The killing switch of the killing control device is arranged on the location suitable for operation. The timing retard circuit module of the killing control device further comprises a voltage division module providing the turn-on voltage of the transistor Q3 to decrease the input impedance and improve the anti-interfere ability. The killing control device further comprises a diode to protect the transistor Q3 when working.

The parameters of the capacitors and the resistances of the timing retard circuit module may be regulated to meet the need for timing retarding. The capacitance range of the capacitor C2 of the killing control device is 0.68 uF~22 uF. The capacitance range of the capacitor C3 is 10 uF~50 uF. The resistance range of the resistor R8 is 30 KΩ-300 KΩ). The resistance range of the resistor R9 is 90 KΩ-300 KΩ.

The invention has following advantages comparing with the prior art: 1. simply manufacture, low cost and stable quality; 2. the engine may be in fully stopping state to ensure the safety of the engine operation; 3. the ignition circuit of the ignition control device may autorecover and the engine is autorecovered to ready-to-start state.

DETAILED DESCRIPTION OF THE EMBODIMENTS

Figure 1:
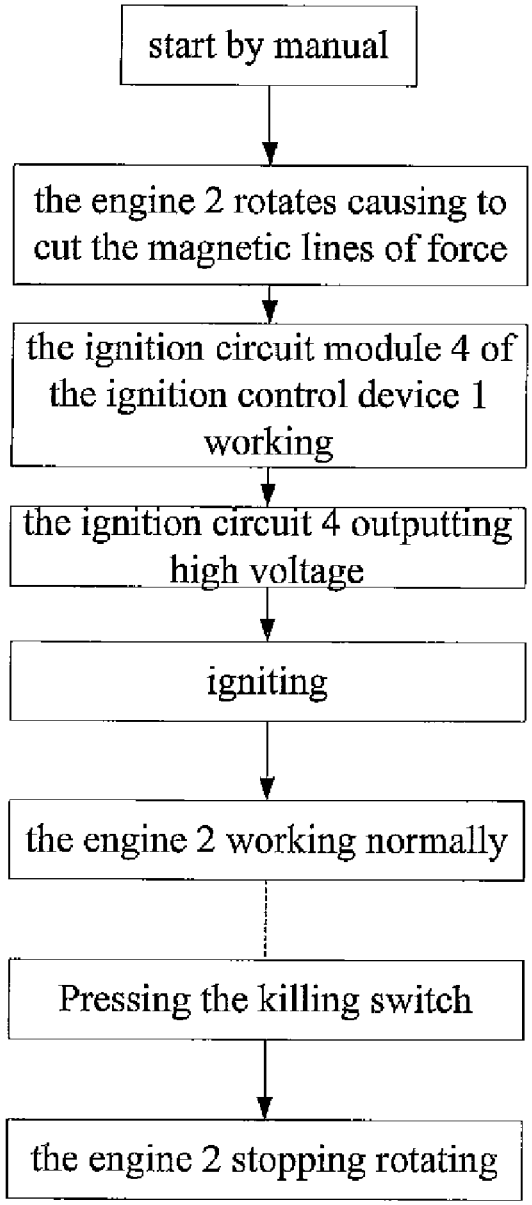
Fig. 1 PRIOR ART
FIG. 1 is a working flow diagram of the prior art.

The embodiments of the invention will be explained in greater detail with reference to the drawings.

Referring to the drawings, the invention starts to work corresponding to the followings: when the operator need to start the engine 2, the engine 2 rotates to cause magnetic lines of force cutting the coil by outside force, then the ignition circuit module 4 of the ignition control device 1 starts to work by the induction of the coil L2 and sends the high voltage to the engine 2 through the high voltage line 7 so that the engine 2 may be ignited and start to work normally; when the operator need to stop the engine, then killing switch K1 is actuated, the killing control device 3 starts to work while the ignition circuit module 4 stops outputting the ignition voltage immediately and then engine 2 isn't ignited; after the killing switch is unactuated, there exists at least one level charge circuit 5 between killing switch K1 and ground, so the ignition circuit 4 is still in no ignition voltage output state until the voltage discharge of the capacitor in the charge circuit 5 ends. At the same time, the engine 2 has fully stopped and closed safely.

Figure 2:
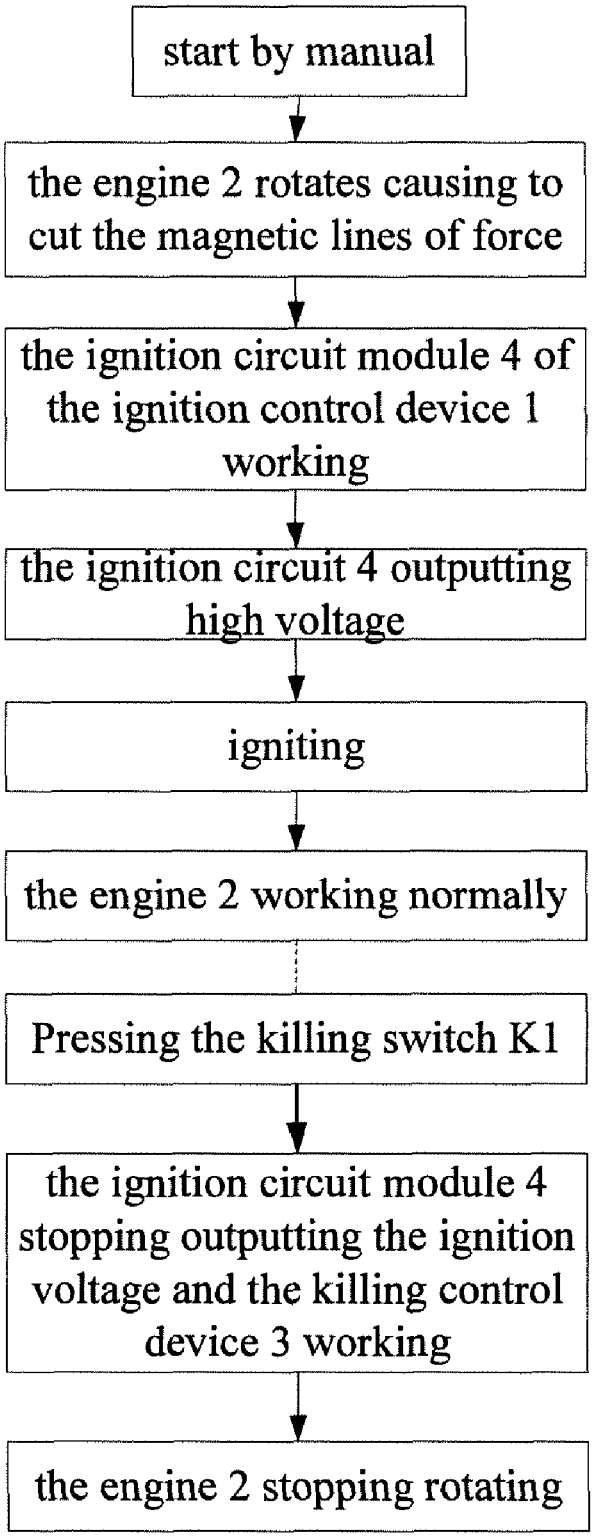
FIG. 2 is a working flow diagram of the present invention.

As shown in FIG. 2, the killing switch K1 may arranged on any location suitable for operating such as the handle of the trimmer in the present invention.

Figure 3:
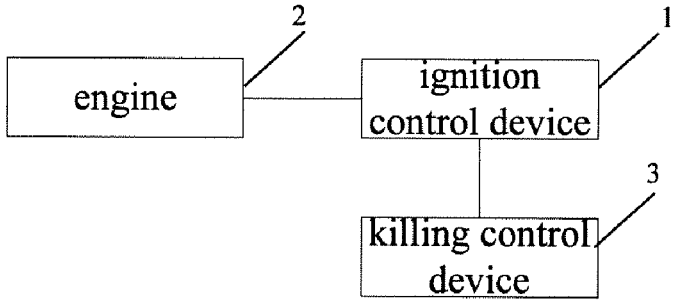
FIG. 3 is a schematic view of the present invention.

As shown in FIG. 3, the engine 2 comprises an ignition control device 1 including an ignition circuit module 4. The invention further comprises a killing device 3 connected to the ignition device 1, wherein the timing retard circuit module 5 is connected to the ignition circuit module 4.

Figure 4:
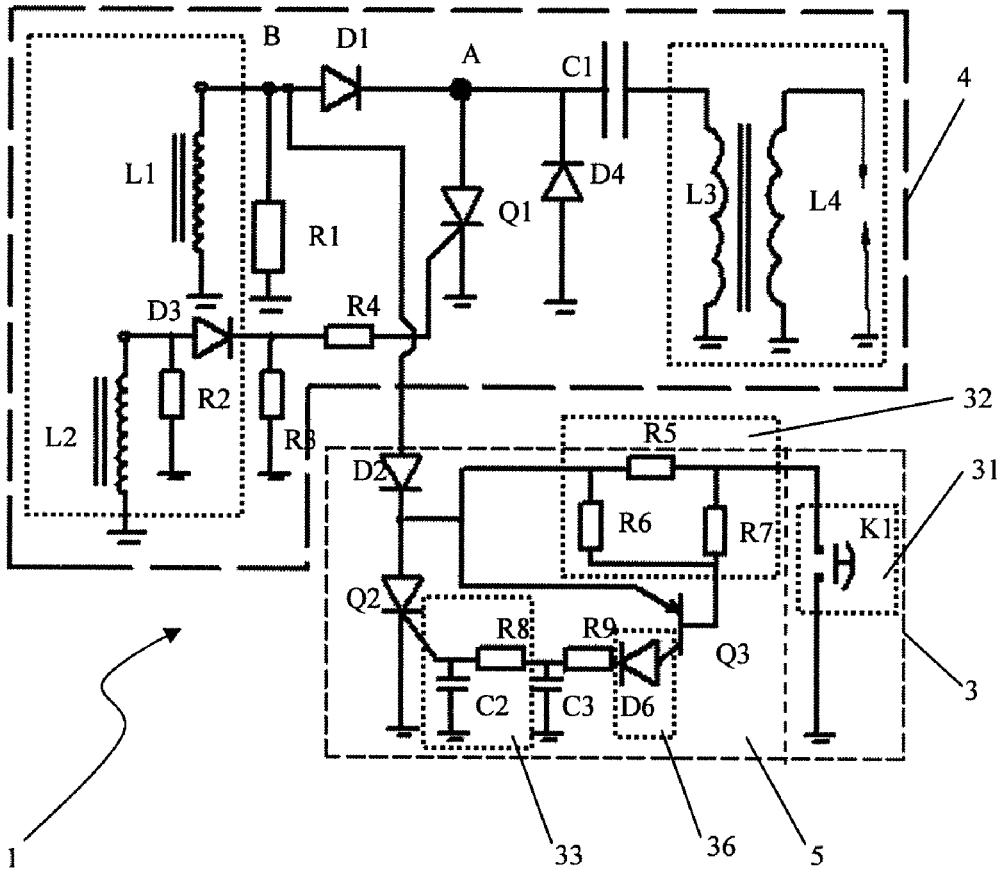
FIG. 4 is a circuit schematic view of an embodiment of the present invention.

The circuit shown in FIG. 4 comprises an ignition circuit module 4 and a timing retard circuit module 5. Said ignition circuit module comprises an induction module and a transformer output module. Said induction module comprises a charge coil L1 and a trigger coil L2. When the engine 2 is rotating and the coil is cutting the magnetic lines of force, said induction module sets the ignition circuit module into a work state through electromagnetic induction. Said transformer output module comprises a primary coil L3 and the ignition circuit outputs high voltage through the coil L4.

The ignition circuit module 4 shown in FIG. 4 further comprises a diode D1, a diode D2, a diode D3, a diode D4, a resistor R1, a resistor R2, a resistor R3, a resistor R4, a SCR Q1, a capacitor C1 and a transformer. A node A is set among the diode D1, the capacitor C1 and the SCR Q1. The anode of the SCR Q1 is connected to the node A and the cathode is grounded. The gate of the SCR Q1 is connected to one side of the resistor R4, the other side of the resistor R4 is connected to the cathode of the diode D3. One end of the resistor R3 is connected between the resistor R4 and the diode D3 and the other end is grounded. One end of the resistor R2 is connected to the anode of the diode D3 and the other end is grounded. The anode of the diode D3 is connected to one side of the trigger coil L2 and the other side of the trigger coil L2 is grounded. At the same time, the node A is connected to one side of the capacitor C1. The other side of the capacitor C1 is grounded through the primary coil L3 of the transformer. The anode of the diode D1 is connected to one side of the charge coil L1 and the other side of the charge coil L1 is grounded. Where the anode of the diode D1 is connected to the charge coil L1 is a node B. One end of the resistor R1 is connected to the node B and the other end is grounded. The cathode of the diode D4 is connected to the node A and the anode is grounded.

The timing retard circuit module 5 shown in FIG. 4 further comprises a killing switch K1, the diodes D2 and D6, SCR Q2, a transistor Q3, the capacitors C2 and C3, the resistors R5, R6, R7, R8 and R9. The anode of the diode D2 is connected to the backend of the charge coil L1. The cathode of the diode D2 is connected to the anode of the SCR Q2, the emitter of the transistor Q3, one end of the resistor R5 and one end of the resistor R6, respectively. The other end of the resistor R6 and one end of the resistor R7 are connected to the base of the transistor Q3. The other end of the resistor R5 is connected to the other end of the resistor R7. One end of the killing switch K1 is connected to the point where the resistor R5 is connected to the resistor R7 and the other end is grounded. One end of the resistor R8 is connected to the gate of SCR Q2 and the other end is connected to one end of the resistor R9. The other end of the resistor R9 is connected to the cathode of the diode D6. The anode of the diode D6 is connected to the collector of the transistor Q3. One end of the capacitor C2 is connected between the resistor R8 and the resistor R9 and the other end is grounded. One end of the capacitor C3 is connected between the resistor R9 and the diode D6 and the other end is grounded.

The timing retard circuit module 5 comprises a charge circuit module 33 including the capacitors C2 and C3 as well as the resistor R8 and R9 to achieve the timing retard. The timing retard circuit module 5 further comprises a voltage division module 32 providing the turn-on voltage of the transistor Q3 to decrease the input impedance and improve the anti-interfere ability. The killing control device 3 further comprises a diode to protect the transistor Q3 when working. The killing control device 3 further comprises a switch.

The level of the charge circuit of the charge circuit module 33 shown in FIG. 4 may be set to one level, two levels or more corresponding to the rotate speed of the engine. The time for the ignition circuit without the ignition voltage output may be controlled so that the engine is fully stopped through selecting the different levels.

The parameters of the capacitors and the resistors of the charge circuit module 33 shown in FIG. 4 may be regulated to suit to the timing retard. The capacitance range of the capacitor C2 of the ignition control device is 0.68 uF~22 uF. The capacitance range of the capacitor C3 is 10 uF~50 uF. The resistance range of the resistor R8 is 30 KΩ-300 KΩ. The resistance range of the resistor R9 is 90 KΩ-300 KΩ.

The parameters of the capacitors and the resistors of the charge circuit module 33 shown in FIG. 4 may be regulated to suit to the timing retard. For example, when C2=1 uF, C3=22 uF, R8=91 KΩ, R9=91 Kω, the timing retard is 3.5 S when the rotate speed of the engine 3000 r/min, the timing retard is 5 S when the rotate speed of the engine 8000 r/min.

Figure 5:
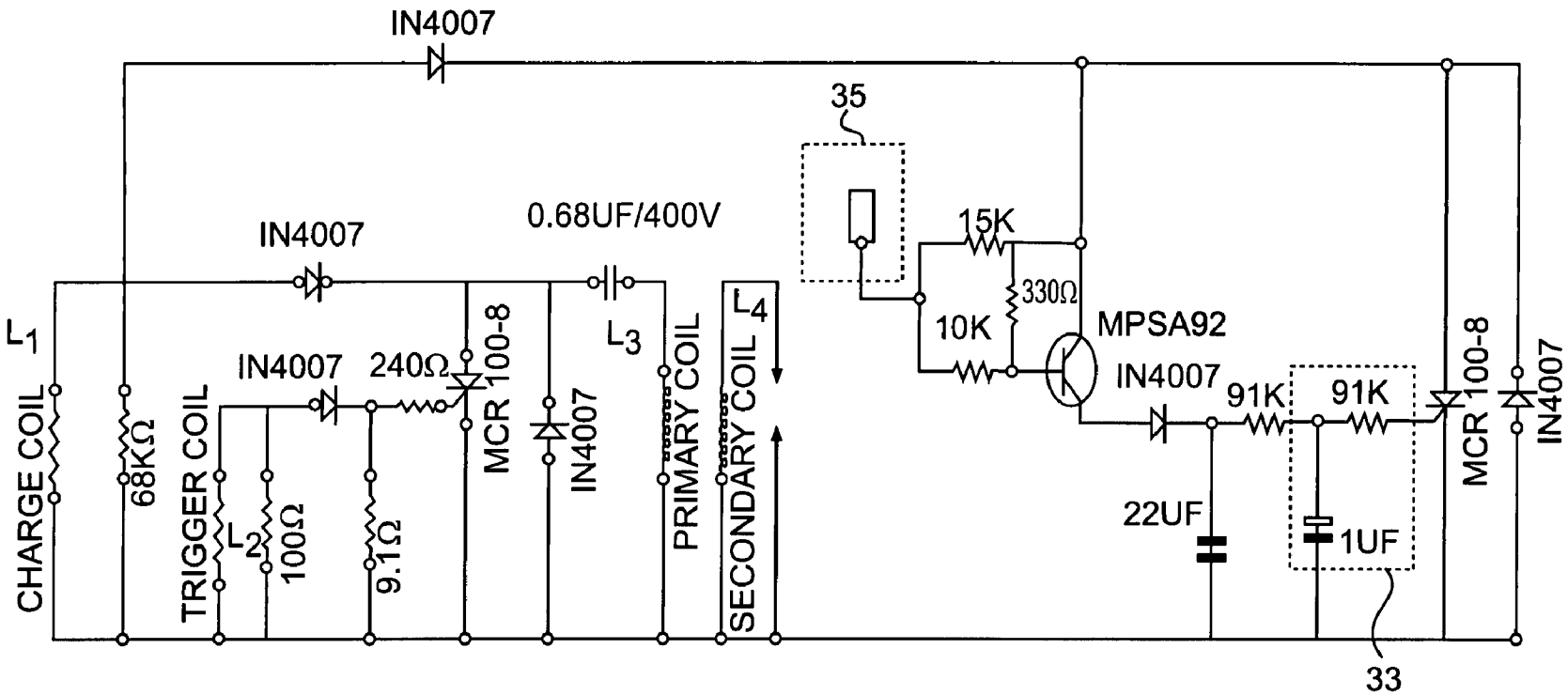
FIG. 5 is a circuit schematic view of another embodiment of the present invention.

FIG. 5 is a circuit schematic view of another embodiment of the present invention which working principle is same as in FIG. 4. The components in FIG. 5 are essentially same as the FIG. 4 so that the type and the parameters of the components may refer to that in FIG. 5. The difference between FIG. 5 and FIG. 4 is that the switch isn't shown in FIG. 5.

The level of the charge circuit of the charge circuit module 33 shown in FIG. 5 may be set to one level, two levels or more corresponding to the rotate speed of the engine. The time for the ignition circuit without the ignition voltage output may be controlled so that the engine is fully stopped through selecting the different levels.

In the module 35 shown in FIG. 5, one end of the killing piece is connected to a switch. The other end of the switch is grounded.

Figure 6:
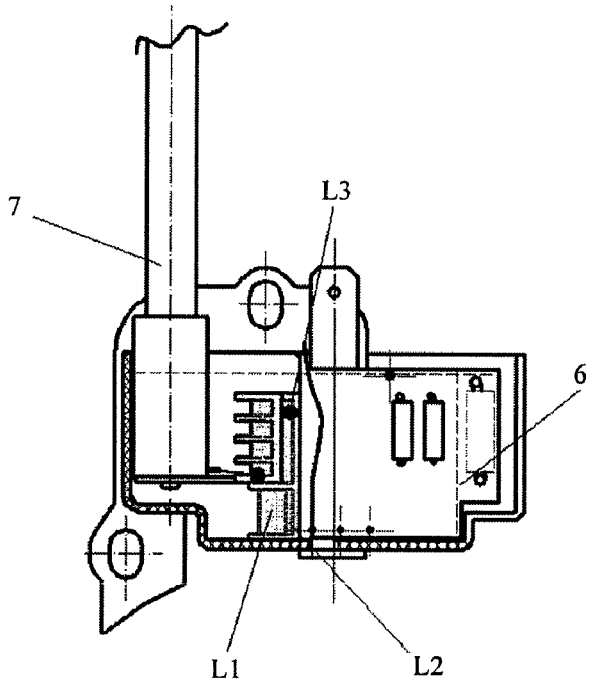
FIG. 6 is a schematic view of an application of the present invention.

FIG. 6 is a schematic view of an application of the present invention comprising a high voltage line 7, a control circuit board 6, a killing control device 3, a charge coil L1, a trigger coil L2 and a primary coil L3. The control circuit board 6 is installed on the face of said ignition device. The part of the ignition control, the trigger coil L2 and the charge coil L1 compose a ignition circuit 4. The killing control device 3 comprises a timing retard circuit 5.

Figure 7:
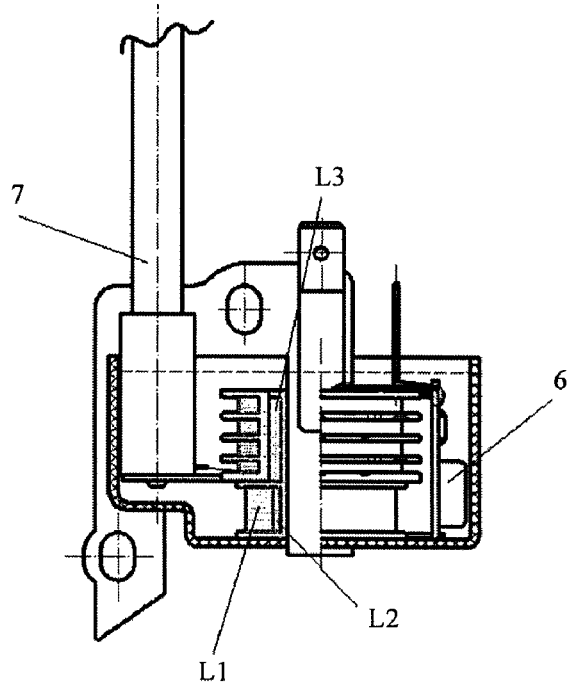
FIG. 7 is a schematic view of another application of the present invention.

FIG. 7 is a schematic view of another application of the present invention, wherein the ignition control device 1 and the control circuit board also may be set at the right of said ignition device.

As the embodiments of the present invention have been described above, it should be understood that the present invention is not limited to the above specific embodiments. Various modifications or alterations can be made by those skilled in the art without departing from the scope as defined by the appended claims.

What is claimed is:

1. An ignition control device comprises:

an ignition circuit module and a killing switch control device;

said killing switch control device including a killing switch and a timing retard circuit module;

said timing retard circuit module including a charge circuit module having capacitors;

wherein when the killing switch is activated, the killing switch control device starts to work and the ignition circuit module stops outputting an ignition voltage;

wherein when the killing switch is deactivated, the ignition circuit module is still in a no ignition voltage output state until a voltage discharge of the capacitors in the charge circuit module ends;

wherein the killing switch control device further comprises a pair of diodes, a silicon controlled rectifier (SCR), a transistor, a pair of capacitors and a quintet of resistors, wherein said charge circuit module comprises the pair of capacitors and a fourth one and a fifth one of the resistor quintet; an anode of a first one of the diode pair is connected to the backend of a charge coil of said ignition circuit module; a cathode of the first diode is connected to the anode of the SCR, an emitter of the transistor, one end of a first one of the resistor quintet and one end of a second one of the resistor quintet, respectively; the other end of the second resistor and one end of a third one of the resistor quintet are connected to a base of the transistor; the other end of the first resistor is connected to the other end of the third resistor; one end of the killing switch is connected to the point where the first resistor is connected to the third resistor and the other end is grounded; one end of the fourth one of the resistor quintet is connected to a gate of the SCR and the other end of the fourth resistor is connected to one end of the fifth one of the resistor quintet; the other end of the fifth resistor is connected to a cathode of a second diode of the diode pair; an anode of the second diode is connected to a collector of the transistor; one end of a first one of the capacitor pair is connected between the fourth resistor and the fifth resistor and the other end of the first capacitor is grounded;

one end of a second one of the capacitor pair is connected between the fifth resistor and the second diode and the other end of the second capacitor is grounded.

2. The ignition control device according to claim 1, wherein parameters of each capacitor and each resistor are regulated to suit to a timing retard.

3. The ignition control device according to claim 1, wherein a capacitance range of the first capacitor is 0.68uF-22uF, a capacitance range of the second capacitor is 10uF-50uF, a resistance range of the first resistor of the resistor pair is 30 KΩ-300 KΩ and a resistance range of the second resistor of the resistor pair is 90 KΩ-300 KΩ.

* * * * *